US005294762A

United States Patent [19]

Kaizu et al.

[11] Patent Number: 5,294,762

[45] Date of Patent: Mar. 15, 1994

[54] CLICK-ACTION MEMBRANE SWITCH UNIT

[75] Inventors: Masahiro Kaizu, Narita; Atsuhiro Horii, Sakura, both of Japan

[73] Assignee: Fujikura Ltd., Tokyo, Japan

[21] Appl. No.: 935,538

[22] Filed: Aug. 25, 1992

[30] Foreign Application Priority Data

Sep. 10, 1991 [JP] Japan ..... 3-258534
Feb. 7, 1992 [JP] Japan ..... 4-022999

[51] Int. Cl.[5] ..... H01H 1/10

[52] U.S. Cl. ..... 200/513; 200/521; 200/310

[58] Field of Search ..... 200/512, 514, 516, 511, 200/521, 293, 513, 310, 312, 317

[56] References Cited

U.S. PATENT DOCUMENTS

| | | | |
|---|---|---|---|
| 4,046,981 | 9/1977 | Johnson et al. | 200/516 |
| 4,463,234 | 7/1984 | Bennewitz | 200/512 |
| 4,501,938 | 2/1985 | Kawauchi | 200/512 |
| 4,618,754 | 10/1986 | Gross | 200/335 |
| 5,144,104 | 9/1992 | Bedoya | 200/512 |

FOREIGN PATENT DOCUMENTS

| | | |
|---|---|---|
| 0322514 | 7/1989 | European Pat. Off. . |
| 0100875 | 2/1984 | Fed. Rep. of Germany . |
| 3333685A1 | 4/1985 | Fed. Rep. of Germany . |
| 2133625A | 7/1984 | United Kingdom . |

*Primary Examiner*—Henry J. Recla
*Assistant Examiner*—David J. Walczak
*Attorney, Agent, or Firm*—Fishauf, Holtz, Goodman & Woodward

[57] ABSTRACT

A click-action membrane switch unit comprises a flexible base film having two surfaces, flexible circuits formed on at least one of the two surfaces of the base film and having interdigitating electrode contacts, a resist film formed on the flexible circuits and having a window in the region of the electrode contacts, a dome-shaped click spring made of electrically conducting material and having an edge placed on the circuits, and a layer fixed to the other surface of the base film and having an opening formed in the portion of the layer which aligns with the click spring.

10 Claims, 4 Drawing Sheets

CLICK-ACTION MEMBRANE SWITCH UNIT

BACKGROUND OF THE INVENTION

1. Field of the Invention

This invention relates to a membrane switch unit of click action type.

2. Description of the Related Art

A click-action type membrane switch unit used on a solid printed circuit board has a number of advantages: it can be operated with high reliability, it can be formed thin, it occupies only a small amount of space and it can be manufactured at low cost. Because of these advantages, this type of switch unit is widely used in the operating key portions of electrical equipment and the like. In particular, the click-action type membrane switch unit is frequently used in printed circuit boards as a switch unit which has a large number of key input portions and can endure high temperatures.

A click-action type membrane switch can also be used in a flexible circuit board.

FIGS. 1 and 2 show a conventional click-action type membrane switch unit which is used in a flexible printed circuit board and comprises a base film 1, upper circuits 2*a* and 2*b* and a lower circuit 3 formed on the upper and lower surfaces of the base film 1, resist films 4 and 5 formed on the upper and lower circuits 2*a*, 2*b*, and 3, electrode contacts 6 extending from each upper circuit and arranged in an interdigitating manner in a circular window 7 formed in the intermediate portion of the resist film 4 and a dome-shaped click spring 8 made of metal having a strong spring force or of any other material having electrical conductivity and covering the electrode contacts 6 and the window 7.

Referring to FIG. 4, when the click spring 8 is depressed from its stationary state, as indicated by a broken line 9, its central portion is deformed by an amount indicated by A and contacts the electrode contacts 6 of the upper circuits 2, as indicated by a broken line 10, whereby the upper circuits 2*a* and 2*b* are electrically connected. When the click spring 8 cannot be depressed more than A, a load required for this displacement A is represented by SA in FIG. 5, which does not provide sufficient feeling to the operator, as indicated by the broken line 14 in FIG. 5.

In order to produce sufficient clicking sensation, however, it is required that the click spring 8 be deformed further by an amount B (i.e., the total displacement indicated by C), as shown by a solid line 12 in FIG. 4. In this case, a load SB is required for the displacement B, as shown in FIG. 5. In an ideal case, the load-displacement characteristic as indicated by a solid line 13 in FIG. 5 is required of a normal click spring, wherein an ample displacement C occurs under a load Sc, which is the sum of the loads SA and SB.

When the click spring 8 of the conventional click-action membrane switch unit is depressed, it is deformed and its central portion contacts the upper surfaces of the electrode contacts 6. Because the switch unit is usually placed on a rigid base, however, the central portion of the click spring 8 cannot be depressed below the level 11 shown in FIG. 4, as a result of which the click spring 8 assumes the form shown by the broken line 10, wherein the degree of depression or the sinking of the click spring 8 is less by the amount B than in the ideal case, resulting in the very poor load-displacement characteristic 14 shown in FIG. 5, as compared with the ideal load-displacement characteristic 13 shown in this figure.

In view of this, the conventional click-action type switch unit has the drawback that it cannot provide the operator with sufficient clicking sensation.

In order to increase the clicking sensation, a click-action type membrane switch unit having a click spring provided with an increased squeezing force for enlarging the displacement thereof was thought of. However, this type of switch unit requires a thicker click spring, which entails drawbacks such that it is no longer possible to form the switch unit thin and the substantial increase in the maximum load applied to the click spring degrades the durability of the switch unit. These are fatal drawbacks when the switch unit is to be miniaturized.

FIG. 3 shows a conventional click-action membrane switch with lighting, which is an application of the click-action membrane switch unit of the conventional type as shown in FIGS. 1 and 2. This switch comprises a base film 1, upper and lower circuits 2 and 3, resist films 4 and 5, electric contacts 6, a circular window 7, and a click spring 8, all arranged similarly to the conventional switch unit shown in FIGS. 1 and 2. The upper resist film 4, a light-loading and diffusing sheet 15, a formed rubber sheet 16 and an outer sheet 17 are laminated one on another. Formed in the light-loading and diffusing sheet 15 and the formed rubber sheet 16 are holes 18 and 19 situated adjacent to each other. The hole 18 houses the click spring 8, and the hole 19 houses a lighting unit 20 comprising an LED bare-chip element 21 mounted on one of the upper circuits 2 and electrically connected to the other upper circuit 2 by means of a bonding wire 22.

The above click-action type membrane switch with lighting also encounters the same problems as the switch unit shown in FIGS. 1 and 2, and described above.

SUMMARY OF THE INVENTION

The object of this invention is to provide a click-action type membrane switch unit which provides the operator with a strong clicking sensation which this type of switch unit is capable of.

In order to achieve this object, a click-action membrane switch unit according to this invention comprises a flexible base film having two surfaces, circuits formed on at least one of the two surfaces of the base film and having interdigitating electrode contacts, a resist film formed on the circuits and having a window in the region of the electrode contacts, a dome-shaped click spring made of electrically conducting material and having a peripheral edge placed on the electrode contacts, and a layer fixed to the other surface of the base film and having an opening formed in the portion of the layer which aligns with the click spring.

It is preferable that the opening of the layer have a smaller diameter than the diameter defined by the edge of the click spring.

The switch unit of this invention provides excellent clicking sensation in spite of it using a thin click-action spring, and enables the contact time of the electrode contacts and the click spring to be prolonged so as to perform delayed recognition to avoid malfunction resulting from chattering. Further, using a thin click-action spring reduces the manufacturing cost of the switch unit.

This click-action type membrane switch unit is applicable to a click-action type membrane switch with lighting.

BRIEF DESCRIPTION OF THE DRAWINGS

This invention can be fully understood from the following detailed description of this invention by way of the preferred embodiments with reference to the accompanying drawings in which.

DESCRIPTION OF THE PREFERRED EMBODIMENTS

Figure 6:
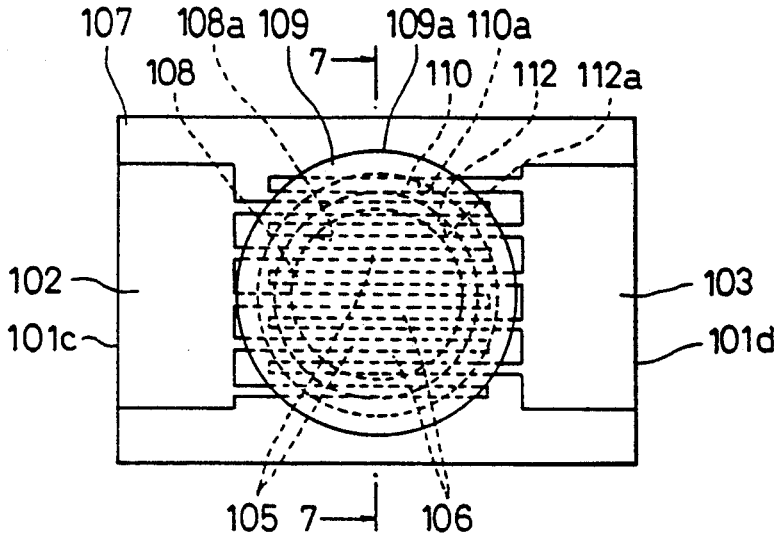
FIG. 6 is a plan view of a click-action type membrane switch unit according to one embodiment of this invention.
Figure 7:
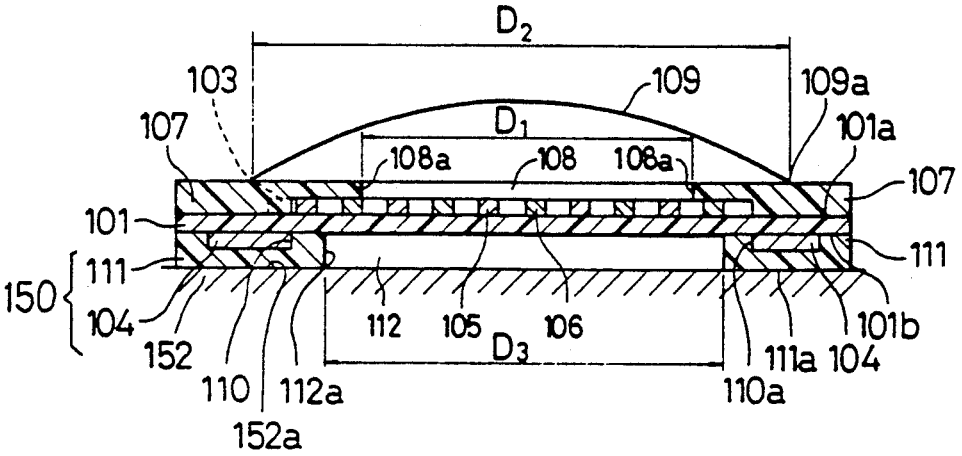
FIG. 7 is a cross-sectional view taken along line 7—7 of FIG. 6, in which the click spring is not depressed.
Figure 8:
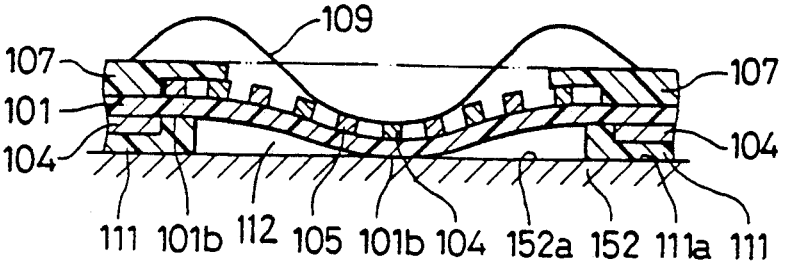
FIG. 8 is a cross-sectional view also taken along line 7—7 of FIG. 6, in which the click spring is depressed fully.

Referring to FIGS. 6 to 8, a click-action type membrane switch unit according to one embodiment of this invention includes a dielectric base film 101 having an upper surface 101*a* and a lower surface 101*b*. Two upper circuits 102 and 103 are formed one on each of the end portions 101*c* and 101*d* of the upper surface 101*a* of the base film 101, and a lower circuit 104 is formed on the lower surface 101*b* thereof. Lower circuit 104 is electrically connected in the switch unit in a conventional manner. Parallel-arranged elongated electrode contacts 105 extend from the inner end of the left upper circuit 102 toward the right upper circuit 103. Likewise, parallel-arranged elongated electrode contacts 106 extend from the inner end of the right upper circuit 103 toward the left upper circuit 102. The electrode contacts 105 and 106 of the left and right upper circuits 102 and 103 are arranged alternately so as to have an interdigitating form as shown in FIG. 6.

Formed on both upper circuits 102 and 103 is an upper resist film 107 provided with a circular window 108 having an inner diameter D1 in the region thereof corresponding to the interdigitating electrode contacts 105 and 106 of the upper circuits 102 and 103.

A dome-shaped click spring 109 having a circular lower edge 109*a* with a diameter D2, larger than the inner diameter D1 of the window 108, is mounted on the upper resist film 107 so as to be disposed coaxially with the circular window 108, with the circular edge 109*a* located to the outside of the circular edge 108*a* of the window 108.

Formed in the lower circuit 104 is a circular opening 110 having a larger inner diameter, defined by the circular inner edge 110*a* thereof, than the inner diameter D1 of the window 108 but smaller than the diameter D2 of the circular edge 109*a* of the click spring 109.

Although smaller than the diameter D2 of the click spring 109, the inner diameter D1 of the window 108 is large enough to allow the click spring 109 to freely contact the electrode contacts 105 and 106 and to be depressed further.

Formed on the lower circuit 104 is a lower resist film 111 provided with a circular opening 112 disposed coaxially with the circular opening 110, the circular window 108, and the click spring 109. The inner edge 110*a* of the opening 110 is covered by the inner peripheral portion of the lower resist film 111. The combination of the lower circuit 104 and the lower resist film 111 is referred to as a layer 150. The opening 112 has a diameter D3 smaller than the diameter D2 defined by the circular edge 109*a* of the click spring 109 but larger than the diameter D1 of the circular window 108. The diameter D3 defined by the circular inner edge 112*a* of the opening 112 is preferably 10% to 20% less than the diameter D2 of the click spring 109.

The switch unit is located on a rigid base 152 with the lower surface 111*a* of the lower resist film 111 in contact with the upper surface 152*a* of the rigid base 152. The click spring 109 is designed such that when the lower surface 101*b* of the base film 101 contacts the upper surface 152*a* of the rigid base 152, the click action of the spring 109 is completed and provides the operator with sufficient clicking sensation.

The exact dimensions of the click spring 109 and the thickness of the base film 101, the circuits 102, 103, and 104 and the resist films 107 and 111 are determined by the displacements B and C and the load-displacement characteristic of the click spring 1. For example, in the case of a total displacement C of 0.25 mm and an amount of sink B of 0.05 mm, the diameter D2 of the peripheral edge of the click spring 1 is 6.0 mm, and the thicknesses of the base film 101, the circuits 102, 103, and 104 and the resist films 107 and 111 are 0.025 mm, 0.018 mm and 0.4 mm, respectively.

The operation of the click-action type membrane switch unit according to this embodiment of the invention will now be described.

Figure 4:
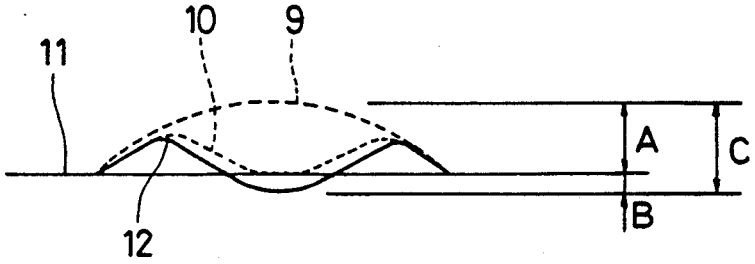
FIG. 4 is a diagram showing the ideal amount of movement of a click spring and the actual amount of movement of the click spring of the conventional click-action type membrane switch unit.
Figure 5:
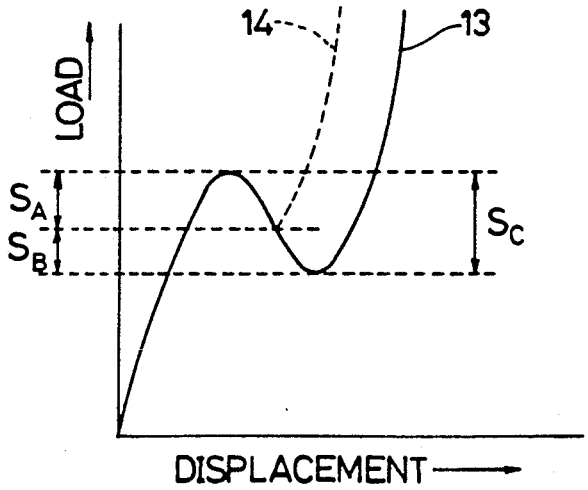
FIG. 5 is a graph illustrating the ideal load-displacement characteristic of the click spring of a normal click-action type membrane switch unit and the actual load-displacement characteristic of the click spring of the conventional type membrane switch unit.

Referring to FIGS. 4, 5 and 8, when the central portion of the click spring 109 is fully depressed, the click spring 109 is deformed, together with the portion of the base film 101 on which the electrode contacts 105 and 106 are provided, until its central portion is fully lowered below the level of the upper surface 101*a* of the base film 101, i.e. at a level prior to the base film 101 having been deformed. The click spring 109 is shown in this state by the solid line 12 in FIG. 4, and possesses the ideal load-displacement characteristic, as shown by the solid line 13 in FIG. 5. Thus, the operator experiences a clear clicking sensation when he or she depresses the click spring 109, thereby confirming that a switching operation has been performed.

When the click spring 109 is released, the spring 109 and the base film 101 each return to their original shapes, respectively.

Figure 9:
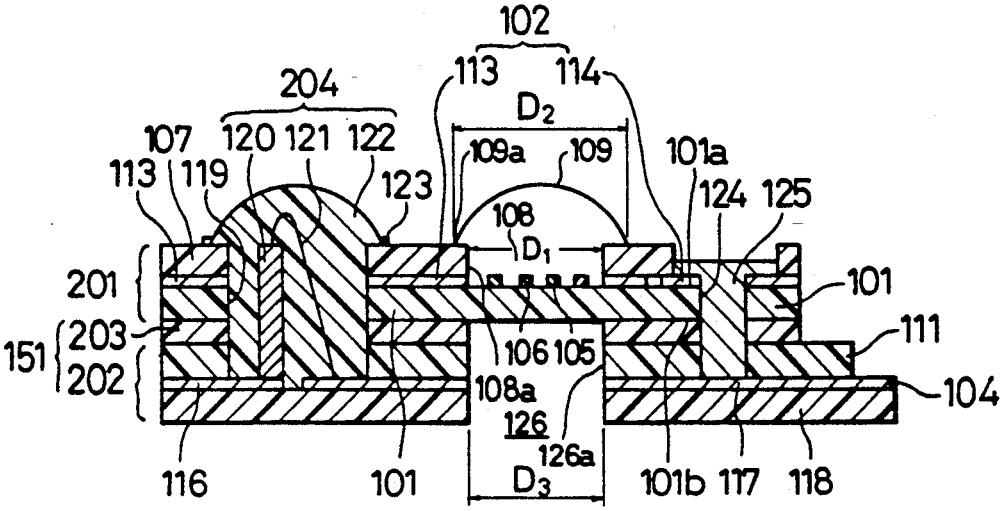
FIG. 9 is a vertical cross-sectional view of a click-action type membrane switch with lighting according to one embodiment of this invention.

Illustrated in FIG. 9 is an embodiment of a click-action type membrane switch with lighting, to which this invention is directed.

The click-action type membrane switch unit has first and second printed circuit plates 201 and 202 fixed together by means of an adhesive layer 203.

The first printed circuit plate 201 includes a dielectric flexible base film 101, circuits 102 comprising a signal circuit 113 and a land pattern 114 both formed on the upper surface 101*a* of the base film 101 in a separated fashion and interdigitating electrode contacts 105 and 106 arranged in parallel to each other on the upper surface 101*a* of the base film 101 between the signal circuit 113 and the land pattern 114, and a resist film 107 formed on the circuits 102.

A circular window 108 having a circular edge 108*a* defining an inner diameter D1 is formed in the portion of the resist film 107 which corresponds to the region of the electrode contacts 105 and 106. A dome-shaped click spring 109 made of metal or any other material having electrical conductivity and having a diameter D2, larger than the inner diameter D1 of the window 108, is disposed on the resist film 107 so as to be coaxial with the window 108. This arrangement is similar to the click-action type membrane switch unit according to the embodiment shown in FIGS. 6 to 8.

The second printed circuit plate 202 includes a resist film 111 similar to that of the embodiment of FIGS. 6 to 8 and having one surface fixed to the adhesive layer 203, circuits 104 comprising an LED-mounting circuit 116 connected to an electric-source terminal and a connecting land pattern 117, one surface of each of which is formed on the other surface of the resist film 111, and a dielectric layer 118 formed on the lower surfaces of the circuits 104.

A common hole 119 is formed in the first printed circuit 201, the adhesive layer 203 and the resist film 111 above the region of adjacent parts of the LED-mounting circuit 116 and the connecting land pattern 117. In the hole 119, an LED bare-chip element 120 is directly mounted on the LED-mounting circuit 116 which is connected to the corresponding one of the circuits 104 by a bonding wire 121. The direct mounting of the LED bare-chip element 120 on the LED-mounting circuit 116 is advantageous over the conventional click-action type membrane switch with lighting, in order that the thickness of the switch itself can be reduced. The LED bare-chip element 120 and the bonding wire 121 are held in a capsule 122 which is made of light-loading and diffusing resin and whose top is dome-shaped with its circular edge limited by a circular dam member 123 formed on the outer surface of the uppermost resist layer 107. In this embodiment, the LED bare-chip element 120, the bonding wire 121 and the capsule 122 constitute an LED 204.

A hole 124 extends through the resist film 107, the land pattern 114, the adhesive layer 203 and the resist layer 111, and a connecting member 125 made of solder paste or electrically conductive paste such as silver paste is used to fill it so as to electrically connect the land pattern 114 to the land pattern 117.

An opening 126 having a circular inner peripheral wall 126*a* defining a diameter D3, smaller than both the diameter D2 of the resist film 107 and the diameter D1 of the click spring 109, extends through those portions of the adhesive layer 203 and the printed circuit plate 202 which are coaxial with the click spring 109 and the circular window 108. The adhesive layer 203 and the printed circuit plate 202 form a layer 151.

Figure 1:
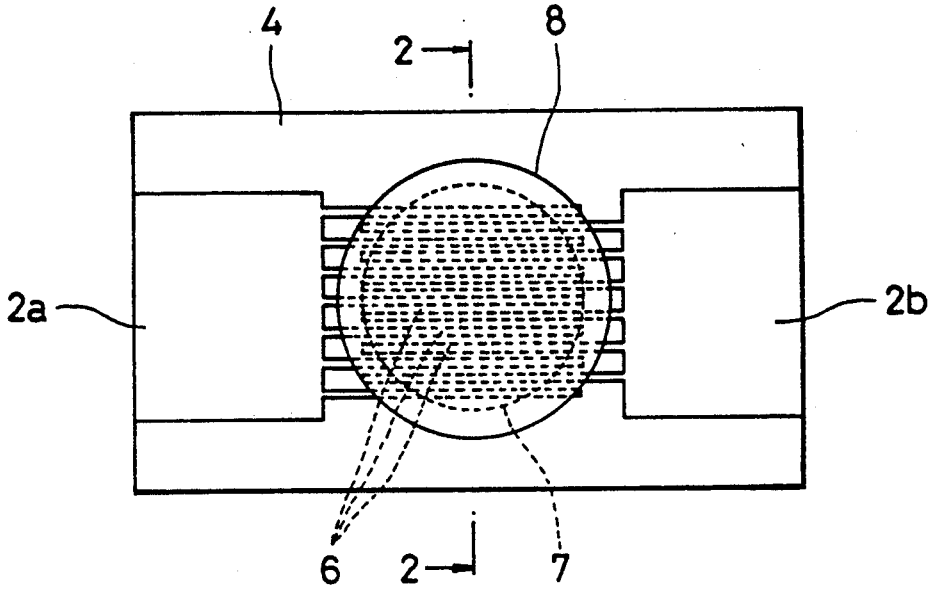
FIG.1 PRIOR ART
FIG. 1 is a plan view of a conventional click-action type membrane switch unit.
Figure 2:
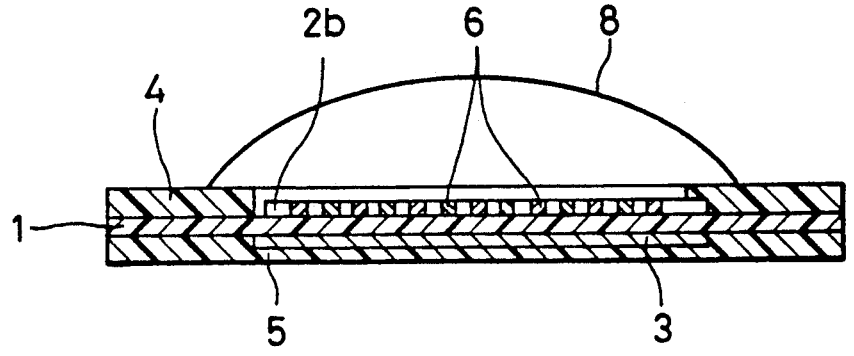
FIG.2 PRIOR ART
FIG. 2 is a cross-sectional view taken along line 2—2 of FIG. 1.
Figure 3:
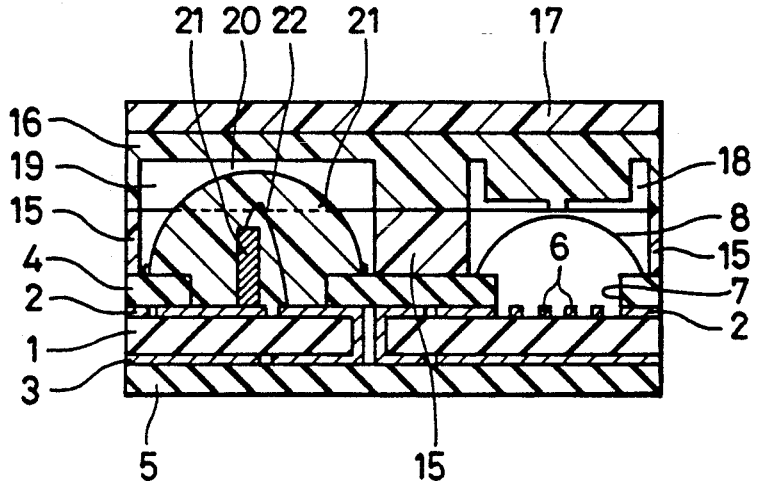
FIG. 3 PRIOR ART
FIG. 3 is a vertical cross-sectional view of a conventional click-action type membrane switch with lighting.

Although not shown in FIG. 9, the switch has a light-loading and diffusing sheet on the uppermost resist layer 107, a formed rubber sheet covering the lighting unit and the membrane switch unit and an outer sheet formed on the outer surface of the formed rubber sheet, like the conventional click-action type membrane switch with lighting shown in FIG. 3.

The operation of the embodiment of this click-action type membrane switch with lighting will now be described.

When the click spring 109 is fully depressed, it is deformed downward and its central portion contacts the electrode contacts 105 and 106, whereby the signal circuit 113 and the land pattern 114 are electrically connected. Thence, the LED bare-chip element 120 is energized to emit light to illuminate a number, a letter or another sign on the outer sheet. The formation of the opening 126 allows the central portion of the click spring 109 to be depressed below the level of the upper surface 101*a* of the base film 101 before the click spring 109 is depressed. This enables the membrane switch unit to be deformed to the ideal degree shown in FIGS. 4 and 5, ensuring satisfactory operation of the click-action membrane switch with lighting.

Figure 10:
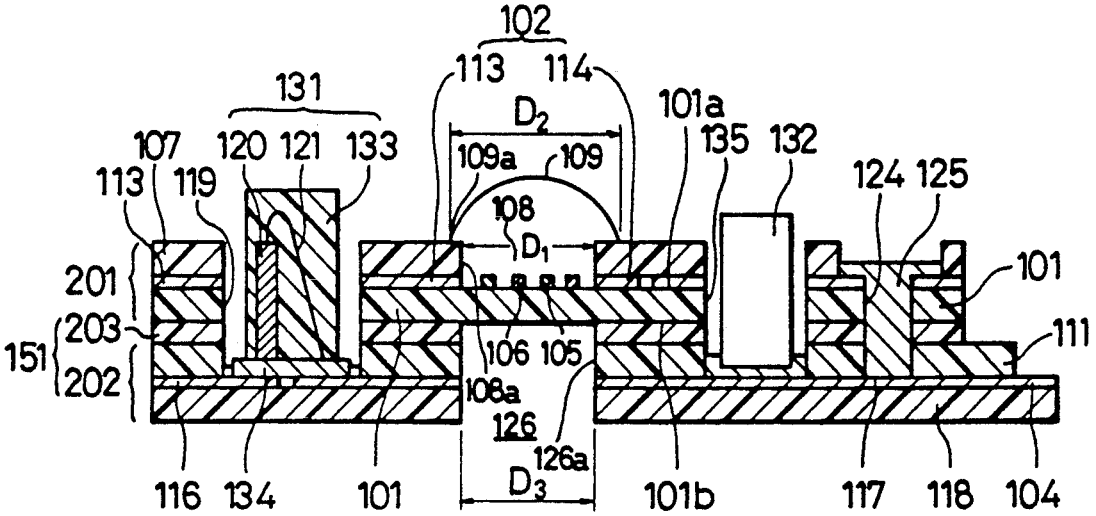
FIG. 10 is a vertical cross-sectional view of a click-action type membrane switch with lighting according to another embodiment of this invention.

FIG. 10 shows another embodiment of a click-action type switch with lighting, employing the click-action type switch unit according to this invention.

The structure of the switch is very similar to that of the switch shown in FIG. 9, except that an LED 131 differs from the LED 204 of the switch of FIG. 9, and the switch of FIG. 10 has an electric component 132 such as a resistor, a capacitor or the like.

The LED 131 comprises an LED bare-chip element 120, a bonding wire 121 for connecting the element 120 to a lower circuit on a ceramic base 134, a capsule 133 containing the element 120 and the wire 121 and mounted on the ceramic base 134. The LED 131 is located in a hole 119 formed in the switch similar to the switch of FIG. 9, with the ceramic base 134 soldered to an LED-mounting circuit 116 and a lower circuit 117.

Another hole 135 extends through an upper resist film 107, a land pattern 114, a base film 101, an adhesive layer 203 and a lower resist film 111. The electric component 132 is located in the hole 135 and soldered to the lower circuit 117.

The other parts of the switch of FIG. 10 are the same as, and designated by the same reference numerals as those of the switch of FIG. 9, and thus description thereof is omitted.

What is claimed is:

1. A click-action membrane switch unit comprising:

a flexible base film having a surface;

circuits formed on said surface of the base film and having interdigitating electrode contacts extending parallel with each other and with said flexible base;

a resist film formed on said circuits and having a window in a region of said electrode contacts;

a dome-shaped click spring made of electrically conducting metal and having an edge placed on said resist film; and a layer fixed to the other surface of said base film and having an opening formed in a portion of said layer which aligns with said click spring, said opening being dimensioned such that said click spring depresses said base film into said opening when said click spring is depressed.

2. The membrane switch unit according to claim 1, wherein each of said window and said opening has a circular shape.

3. The membrane switch unit according to claim 2, wherein said click spring has a circular edge defining a diameter and said opening has an inner diameter which is smaller than said diameter of said circular edge of said click spring.

4. The membrane switch unit according to claim 3, wherein said inner diameter of said opening is 10% to 20% smaller than said diameter of said circular edge of said click spring.

5. The membrane switch unit according to claim 3, wherein said window has an inner diameter smaller than said inner diameter of said opening.

6. In a click-action type membrane switch unit with lighting, including a first printed circuit plate comprising a flexible base film having first and second surfaces, first circuits having a signal circuit and a land pattern, both formed on said first surface of said base film and a first resist film formed on said first circuits, a second printed circuit plate comprising a second resist film having third and fourth surfaces, said third surface being connected to the second surface of said base film, second circuits having an LED-mounting circuit and a connecting land pattern electrically connected to said land pattern of said first circuits and both formed on said fourth surface of said second resist film and a layer formed on said second circuits, an LED connected to said LED-mounting circuit and said connecting land pattern, and a click-action type membrane switch unit disposed adjacent to said LED in said click-action type membrane switch unit with lighting, said click-action type membrane switch unit comprising;

interdigitating electrode contacts formed on said first surface of said base film between said signal circuit and said land pattern of said first circuits and extending therefrom, a dome-shaped click spring made of electrically conducting material and covering a region of said electrode contacts on said first resist film, a window formed and disposed in said first resist film so as to align with said electrode contacts, and an opening formed coaxially with said click spring in said second printed circuit plate.

7. The membrane switch unit according to claim 6, wherein each of said window and said opening has a circular shape.

8. The membrane switch unit according to claim 7, wherein said click spring has a circular edge defining a diameter and said opening has an inner diameter which is smaller than said diameter of said circular edge of said click spring.

9. The membrane switch unit according to claim 8, wherein said inner diameter of said opening is 10% to 20% smaller than said diameter of said circular edge of said click spring.

10. The membrane switch unit according to claim 8, wherein said window has an inner diameter smaller than said inner diameter of said opening.

* * * * *